US005410988A

United States Patent [19]

Miyama et al.

[11] Patent Number: 5,410,988

[45] Date of Patent: May 2, 1995

[54] TUBULAR FURNACE AND METHOD OF CONTROLLING COMBUSTION THEREOF

[75] Inventors: Hiroshi Miyama, Yokosuka; Tetsuhiko Ohki, Tokyo; Hitoshi Kaji; Ryosuke Shimizu, both of Yokohama; Ryoichi Tanaka, Tokyo; Mamoru Matsuo, Zama; Masao Kawamoto; Hirokuni Kikukawa, both of Yokohama, all of Japan

[73] Assignees: Nippon Furnace Kogyo Kabushiki Kaisha; Chiyoda Corporation, both of Kanagawa, Japan

[21] Appl. No.: 241,015

[22] Filed: May 11, 1994

[51] Int. Cl.[6] ..... F22B 13/10

[52] U.S. Cl. ..... 122/250 R; 122/18

[58] Field of Search ..... 122/14, 18, 19, 245, 122/248, 250 R, 7 R

[56] References Cited

U.S. PATENT DOCUMENTS 4,494,485 1/1985 Kendall et al. ..... 122/250 R
4,574,746 3/1986 Keyes, IV et al. ..... 236/14 X
4,658,762 4/1987 Kendall ..... 122/250 R
4,986,222 1/1991 Pickell et al. ..... 122/250 R

*Primary Examiner*—Denise L. Gromada
*Attorney, Agent, or Firm*—Notaro & Michalos

[57] ABSTRACT

A tubular furnace uses a fluid to be heated which is prevented from coking or a heating tube which is prevented from burning. Heat is provided through a smaller heat transfer area and problems of corrosion at low temperature of the heating pipe in the tubular furnace due to sulfur content in the fuel are solved, to thereby achieve a high efficiency. A coil path(3) is divided into a plurality of zones(*2a,2b,2c,2d*), each with at least one regenerative-heating-type alternate combustion system(4). The system supply combustion air to burners(5,6) through regenerative beds(7,7) and the discharge of combustion gas therefrom. Combustion is independently controlled in each zone to create a desired heat flux pattern such that a boundary layer temperature of the fluid to be heated in the zones(*2a,2b,2c,2d*) of the coil path(3) is lower than a coking temperature or lower than an allowable maximum temperature to be determined by the material of the heating pipe.

8 Claims, 7 Drawing Sheets

TUBULAR FURNACE AND METHOD OF CONTROLLING COMBUSTION THEREOF

TECHNICAL FIELD

The present invention relates to a tubular furnace and method of controlling combustion of the tubular furnace.

BACKGROUND ART

Tubular furnaces are primarily used in oil refining and designed to burn fuel in a combustion chamber comprising a casing made of steel plates, the inner side of which is lined with refractory and heat insulating material, and to heat petroleum or other oil flowing in heating tubes (steel tubes) arranged within the combustion chamber by using generated heat.

Such a tubular furnace has an important problem of coking. The term "coking" means a phenomenon that a fluid to be heated is decomposed and altered into cokes, and taking steps to prevent coking is considered to be an important issue from the standpoints of design and operation in tubular furnaces which primarily handle hydrocarbon.

As steps to prevent coking, therefore, it has conventionally been practiced to select the value of heat flux such that a boundary layer temperature is held lower than a coking temperature, and to select a dimension of a tube diameter such that the flow velocity in the tube is held in an appropriate range. From this point, ordinary values of a heat flux and a flow velocity are specified in furnaces for heating residual oil that is highly likely to cause coking, such as furnaces heating raw material for atmospheric distillation apparatus or vacuum distillation apparatus, for example.

Meanwhile, from the viewpoint of energy conservation, a conventional tubular furnace is arranged as shown in FIG. 1, for example, such that a convection heat transfer section 102, in which a fluid to be heated is primarily heated by convection heat transfer, is provided in an upper part of a furnace 101, a radiant heat transfer section 103, in which the fluid is primarily heated by radiant heat transfer, is provided in a lower part of the furnace 101, and combustion gas generated by a burner combustion equipment 104 at the bottom section of the furnace 101 is exhausted through an exhauster 105 at the top of the furnace 101. A coil path in this furnace 101 is formed by connecting together the groups of heating tubes 106 arranged in the furnace into one unit of heating tube via U-shaped connecting tubes (not shown). The coil path has an inlet 107 located near the top of the furnace 101 in the convection heat transfer section 102 and an outlet 108 located near the bottom of the furnace 101 in the radiant heat transfer section 103. Therefore, the fluid to be heated, which is introduced into the heating tubes 106 from the inlet 107, is heated by the exhaust combustion gas at a relatively low temperature in the convection heat transfer section 102 and flowed in the downstream direction, and further heated by radiant heat of the combustion gas at a relatively high temperature in the radiant heat transfer section 103. Then, the fluid is drawn out from the outlet 108. In this case, since the boundary layer temperature of the fluid to be heated becomes maximum at near the outlet 108 of the coil path located in the radiant heat transfer section 103, the heat flux is set such that the boundary layer temperature of the fluid near the outlet 108 of the coil path is held lower than the coking temperature.

However, in the conventional tubular furnace, the inside of the furnace is heated by the burner 104 provided at the bottom section as one zone, with the result that a temperature in the furnace becomes lower as it proceeds towards the outlet of coil path located at the top end of furnace. Moreover, with the heat flux of the burner 104 being set such that the boundary layer temperature is held lower than the coking temperature at near the outlet 108 of the coil path where the boundary layer temperature becomes maximum, the heat flux is decreased down to an excessive small value as it proceeds towards the coil path inlet 107. In general, a usable maximum temperature of the furnace is defined by a wall thickness and a material of the heating tube 106, but in the present conventional case, such temperature is also determined in relation to the outlet 108 of the furnace 101 and thus, the heat flux near the outlet becomes an excessive small value as similar to the foregoing case for preventing coking. It is desired that heat flux in all areas of coil path should be increased up to a level close to a critical limit within which coking will not occur to raise heating efficiency. But, the heat flux in the conventional furnace 101 is smaller entirely except about the outlet 108 of the furnace 101, especially, the heat flux near the inlet 107 is a smaller value than desired so that heating efficiency is not so good and a big size furnace is required in order to increase the treating quantity and the refining quantity.

In addition, the convection heat transfer section 102 is provided in the upper part of the furnace 101, from which the combustion gas is exhausted, further to recover heat of the combustion gas becoming low temperature in the conventional furnace 101. Because of sulfur being contained in fuel, however, a tube wall temperature of heating tube 106 is required to be held higher than a acid dew point temperature from the standpoint of preventing low-temperature corrosion. This results in a problem that because of the combustion exhaust gas cannot being exhausted at a lower temperature, improvement of heat efficiency by recovering exhaust heat is not so sufficient and influences upon surrounding environment would be increased.

DISCLOSURE OF THE INVENTION

The purpose of this invention is to provide a tubular furnace and a method of controlling combustion of the furnace, by which a predetermined quantity of heat is given with a smaller heat transfer area while preventing a fluid to be heated from coking or preventing a heating tube from burning, in other words, to provide those having high heating efficiency. The other purpose of this invention is to provide a tubular furnace and a method of controlling combustion thereof, by which the problem of low-temperature corrosion of the heating tube attributable to sulfur contained in fuel is solved while ensuring high heat efficiency.

To achieve the above purpose, by dividing a coil path continued from an inlet of the furnace to its outlet into a plurality of zones and disposing at least one or more regenerative-heating-type alternate combustion systems for each of the zones which carry out to supply combustion air and exhaust combustion gas alternatively through a regenerative bed, the temperature in the furnace is optionally controlled for each of the zones. The division of the coil path in relation to the zones is formed by, for example, pass partition plate that is a part of the furnace body being protruded to the coil path and the regenerative-heating-type alternate combustion systems which are provided on the pass partition plates, its flame being formed parallel to the coil path. That division in other embodiment is formed by heating tubes which are some of heating tubes and protruded to the innerside from the wall surface of the furnace body. The other division of the coil path in relation to the zones is formed by the independent plural furnace bodies.

With such an arrangement, a fluid to be heated flowing through a heating tube is progressively heated by the regenerative-heating-type alternate combustion systems in each zone of the coil path with the aid of radiant heat transfer. On the other hand, the combustion gas generated in each zone is exhausted to the outside of the furnace via an inoperative burner of the regenerative-heating-type alternate combustion systems and associated regenerative bed in same zone, thus causing the combustion gas to flow out from each zone in an amount corresponding to that generated in the same zone. Such a temperature change in the furnace takes place in only each zone and will not affect any other adjacent zones. Namely, since the exhaust combustion gas generated in each zone is exhausted to the outside of the furnace from the same zone, a satisfactory degree of zone temperature control and heat flux pattern (distribution) can be realized. Accordingly, by adjusting the amount of combustion of the regenerative-heating-type alternate combustion systems for each of the zones, the in-furnace temperature in each zone is changed independently for each zone and each heat flux pattern for each zone can optionally be set. Accordingly, each heat flux pattern for each zone can be set to such a pattern that the boundary layer temperatures of the fluid to be heated for all the zones are held lower than the coking temperature or the allowable maximum temperature which is determined in consideration of material used as the heating tube and are almost the same temperature level.

Whereby, the heat flux at an inlet zone with a margin relative to the coking temperature can be increased while preventing the occurrence of coking and heating efficiency can be increased. It is thus possible to provide for the fluid to be heated a predetermined quantity of heat with a smaller heat transfer area than that of the conventional furnace.

Accordingly, in a high-temperature furnace in which the allowable tube wall temperature is determined from the high-temperature strength of material used, such as a furnace handling a high-temperature fluid, higher efficiency can be achieved with less total heat transfer area, while moderating conditions in use of the heating tube. This results in more compact size of the furnace if the treating quantity is the same, and increasing the treating quantity if the size of the furnace is the same. Moreover, the wall surface temperature of heating tube is also higher at the inlet zone of the coil path so that low-temperature corrosion of the coil path can be avoided.

Also, the high temperature exhaust combustion gas which is exhausted to the outside of the furnace through the regenerative bed of the regenerative-heating-type alternate combustion systems is exhausted to the outside of the furnace through the regenerative bed at a relatively low temperature to the atmosphere after the sensible heat of the combustion gas is recovered by the regenerative bed by means of direct heat exchange. The recovered heat by the regenerative bed is utilized to preheat the combustion air by means of direct heat exchange and is returning to the inside of the furnace again. With such direct heat exchange, the combustion air can take a high temperature close to the temperature of the combustion gas flowing out from the furnace to the regenerative bed.

Therefore, the heat recovery from the combustion gas achieve the higher heating efficiency by recovering exhaust heat and contributes to energy conservation and enables the furnace provided with no convection portion to achieve heat efficiency comparable to that obtainable by a furnace provided with a convection portion.

With the tubular furnace of the present invention, each heat flux pattern by the regenerative-heating-type alternate combustion systems in the respective zones can be set to such a pattern that the boundary layer temperatures of the fluid to be heated for all the zones are held lower than the coking temperature or the allowable maximum temperature which is determined in consideration of material used as the heating tube and are almost the same temperature level so that the best heating efficiency can be achieved.

In the tubular furnace of the present invention, the arrangement of the regenerative-heating-type alternate combustion systems may be such that two burners, each having a regenerative bed, are provided as a pair and combined together to present a pair of two burners, and that a combustion is alternately effected between the two burners for a short period of time.

Furthermore, a combustion control for the tubular furnace of the present invention is performed easily in such a manner as to determine a combustion amount of the regenerative-heating-type alternate combustion systems beforehand for each of the zones in match with the heat flux pattern, and control the amount of combustion in the entire furnace so that the temperature of the fluid to be heated at the outlet of the furnace is held at a set temperature without changing the ratio of the combustion amount for each zone to the entire combustion amount. Also, by detecting the outlet temperature of the fluid to be heated for each of the zones and controlling the amount of combustion for each zone so that the outlet temperature of the fluid to be heated is held at the set temperature, more accuracy combustion control can be realized.

BEST MODE TO PRACTICE THE INVENTION

Now, referring to the embodiments illustrated in the figures, the constitution of the present invention shall be explained in detail.

Figure 1:
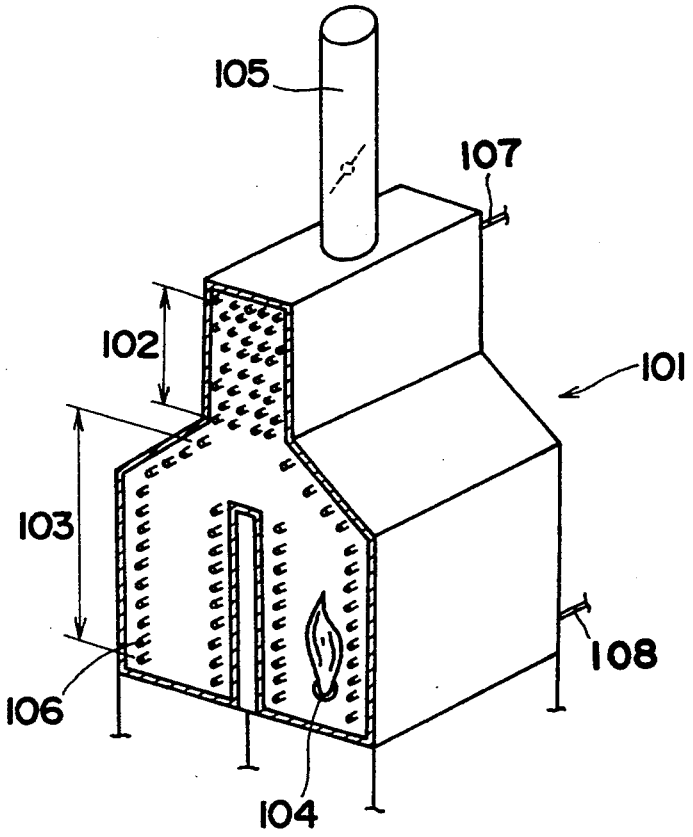
FIG. 1 (PRIOR ART)
FIG. 1 is a schematic view showing a conventional tubular furnace.
Figure 2:
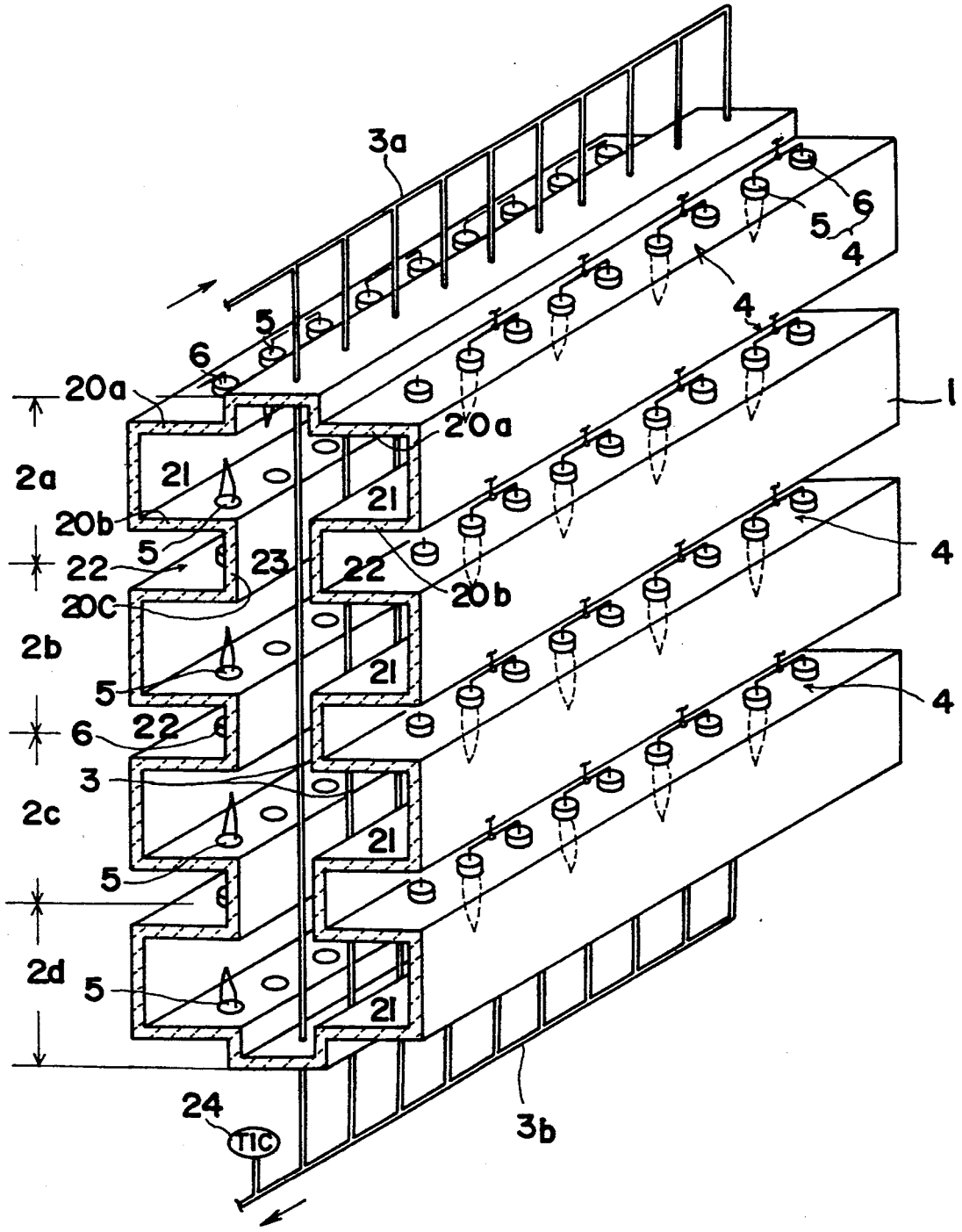
FIG. 2 is a schematic view in section showing one embodiment of a tubular furnace of the present invention.

FIG. 2 shows first embodiment of a tubular furnace of the present invention. The tubular furnace of this embodiment consists of a furnace body 1 comprising a casing made of steel plate, the inner side of which is lined with refractory and heat insulating material, coil paths 3 being provided in the furnace body 1 and in which the fluid to be heated is flowed, and regenerative-heating-type alternate combustion systems 4 which becomes heat source. There are plural coil paths in this embodiment. Each of the coil paths 3 is composed of a straight heating tube and each of the heating tubes 3 (coil paths 3) is provided in the center of the furnace 1 perpendicularly, and then the end of each of the coil paths is connected to a flow dividing tube 3*a* distributing the fluid to be heated before introduction into the furnace out of the furnace body 1, the other end is connected to a collecting tube 3*b* collecting the fluid to be distributed to each of the heating tubes 3. Although there are plural coil path illustrated In FIG. 2, the present invention is not particularly limited to that construction and a coil path may be provided. The furnace body 1 as illustrated is partitioned into a plurality of zones 2*a*, 2*b*, 2*c* and 2*d* by forming pass partition plates 20*a*, 20*b* in an integral manner, which are a part of the furnace wall and are extruded. In other words, the furnace is formed by connecting together four generally cross-shaped furnace bodies in the vertical direction thereof, while establishing an opened communication among them in the same vertical direction. Inner paces 21 of the furnace between the upper pass partition plate 20*a* and the lower pass partition plate 20*b* are combustion chambers to form flames and inner spaces 22 of the furnace are disposing spaces of burners for disposing at least one or more regenerative-heating-type alternate combustion systems 4. The upper and lower pass partition plates 20*a*, 20*b* of which the combustion chamber is composed are connected to other pass partition plates 20*a*, 20*b* in other zones 2*b*, 2*c* and 2*d* each other by vertical joint walls 20*c* . And, a central passage 23 which communicate each zones 2*a*, 2*b*, 2*c* and 2*d* is provided between the opposite right and left joint walls 20*c*.

At least one or more regenerative-heating-type alternate combustion systems 4, preferably plurality of burner system 4 for equalization of heat flux pattern, are disposed in each of the zones 2*a*, 2*b*, 2*c* and 2*d*. In other words, the plurality of zones 2*a*, 2*b*, 2*c* and 2*d* having their regenerative-heating-type alternate combustion systems 4, 4, . . . , 4 independent from each other are interconnected to constitute the single tubular furnace as a whole, and the heating zone of the coil paths or the heating tubes 3 passing through the furnace is divided into a plurality of zones.

Figure 3:
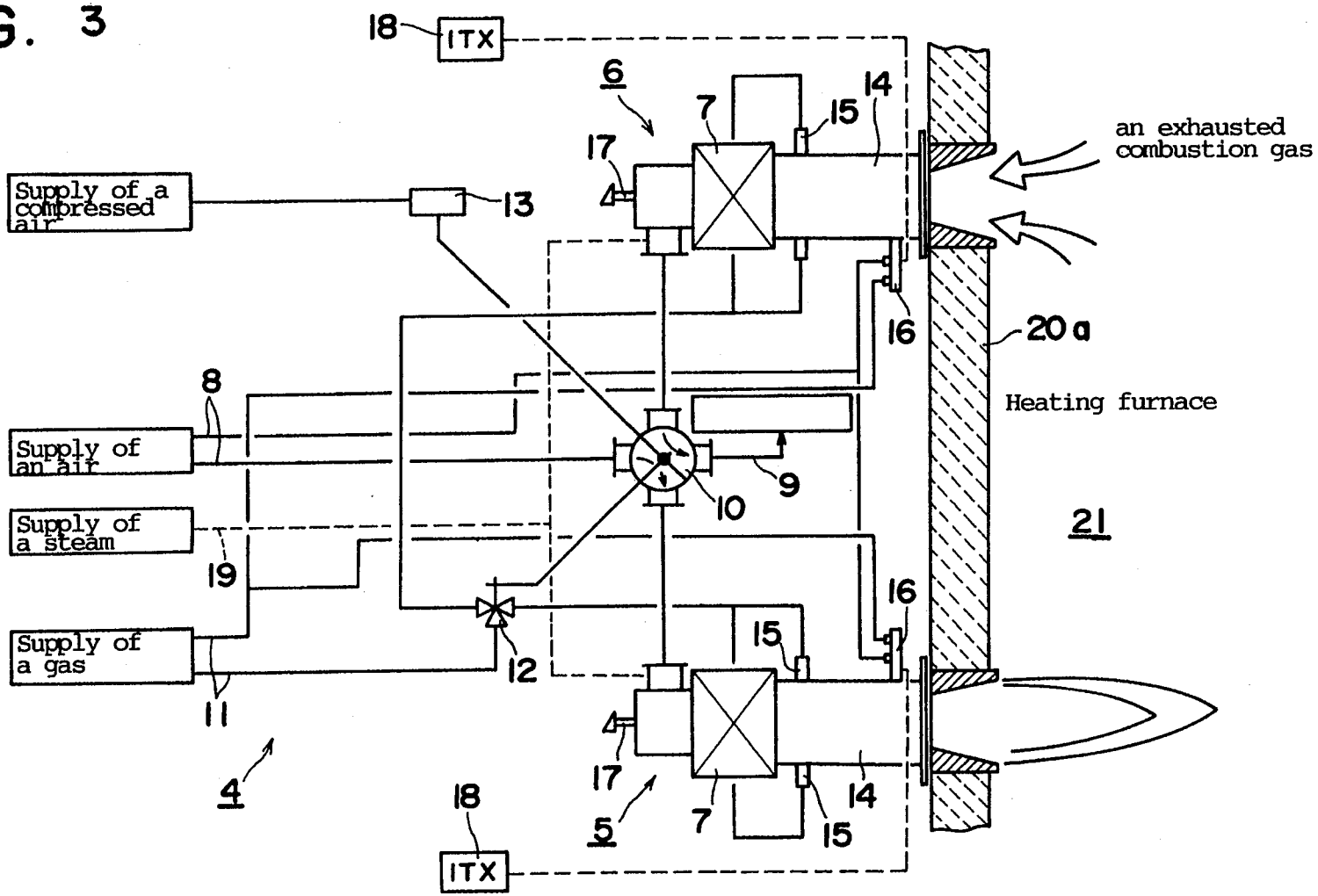
FIG. 3 is a schematic principle view showing one embodiment of regenerative-heating-type alternate combustion systems practiced in the tubular furnace of the present invention.

In this case, the regenerative-heating-type alternate combustion systems 4 uses such a burner system that two units, each of which comprises a regenerative bed and a burner integrally assembled by coupling a duct having the regenerative bed built therein to a burner body, are combined to effect combustion alternately, and exhaust gas can be exhausted through the burner and the regenerative bed which are not in combustion. As shown in FIG. 3, for example, a combustion air supply system 8 for supplying combustion air and a combustion gas exhaust system 9 for exhausting combustion gas are provided to be selectively connectable with respective regenerative beds 7, 7 of burners 5, 6 in two units through a four-way valve 10, so that the combustion air is supplied to one burner 5 (or 6) through the regenerative bed 7 and the combustion gas is exhausted from the other burner 6 (or 5) through the regenerative bed 7. The combustion air is supplied by a forced fan as not illustrated, for example, and the combustion gas is sucked from he inside of the furnace by exhaust means, e.g., an induced fan as not illustrated, and then exhausted out to the atmosphere. Also, a fuel supply system 11 is selectively connected to one of the burners 5, 6 through a three-way valve 12 in an alternate manner for supplying fuel. Fuel nozzles 15 are, for example, embeded into a throat portion of the burner body 14 and its injection portion is provided at inner surface of the throat portion so that the nozzles are not exposed to the combustion gas. In the case of this embodiment, the four-way valve 10 for changing over flow passages of the exhaust combustion gas and the combustion air and the three-way valve 12 for changing over flow passages of fuel are illustrated as a scheme of changing over all the flow passages at a time by a single actuator 13. However, the changeover scheme is not limited to the disclosed one and, the three-way valve 12 and the four-way valve 10 may be controlled separately from each other. Further, the combustion air and the fuel are also distributed in part to pilot burner guns 16. Additionally, denoted by reference numeral 14 in the figure is a burner body, 16 is a pilot burner gun, 17 is a flame sensor, 18 is a transformer for igniting the pilot burner, and, though not shown, solenoid valves, manual valves, etc. are installed in each line. A line 19 for supplying steam is connected to the line 8 for supplying the combustion air. The steam is used to suppress an increase of an NOx exhaust value due to preheating of the combustion air, and the similar effect is obtained by using water as well. The regenerative beds 7, 7 each preferably comprise a cylinder having a number of honeycomb-like cell holes and formed of material which has great heat capacity and high durability with relatively small pressure loss, e.g., fine ceramics. However, the regenerative bed is not particularly limited thereto and may be of any other regenerative bed.

In this embodiment, one regenerative-heating-type alternate combustion system 4 is constituted of one pair of the burners 5, 6 which are disposed on the same pass partition plate 20*a* (or 20*b*) side by side, and the pair is one of the plurality pairs of the burners 5, 6 respectively disposed on opposite upper and lower pass partition plates 20*a*, 20*b* which jointly constitute the combustion chamber 21 in each of the zones 2*a*, 2*b*, 2*c* and 2*d* of the furnace 1. And then, the exhaust combustion gas is exhausted like a two-way passage between the above pair and the other pair of burners 5, 6 (regenerative-heating-type alternate combustion system) on the opposite pass partition plate 20*b* (or 20*a*). More to put it concretely, for example, the combustion gas exhausted from the burner 5 of the regenerative-heating-type alternate combustion system 4 on the upper pass partition plate 20*a* is exhausted through the burner 6 of the other regenerative-heating-type alternate combustion system on the opposite lower pass partition plate 20*b*, and at the same time, the combustion gas exhausted from the burner 5 of the regenerative-heating-type alternate combustion system 4 on the lower pass partition plate 20*b* is exhausted through the burner 6 on the upper pass partition plate 20*a* so that it can be mentioned that the combustion and the exhaustion of the combustion gas is alternately carried out between by the pairly burners in adjoining substantially. In this case, since the fuel and the combustion air are selectively supplied to one of the burners adjacent to each other on the same pass partition plate, the tubing can be achieved with the shortest distance. Namely, the burners disposed on the same pass partition plates 20*a*, 20*b* may be combined to constitute one regenerative-heating-type alternate combustion system 4, and the flow of the combustion gas is changed between the regenerative-heating-type alternate combustion systems 4, 4 disposed in opposite and in both sides of the combustion chamber 21, and a flame is formed parallel to the heating tube 3, and further the combustion gas is exhausted through the burner on the other pass partition plate. Same operations are carried out in the regenerative-heating-type alternate combustion system of the combustion chamber 21 oppositing relative to the heating tube 3.

By the way, the arrangement of the burners is not limited to the above one. For example, the burners disposed on the upper and lower pass partition plates may be combined to constitute one regenerative-heating-type alternate combustion system 4.

With the arrangement explained above, by bringing one burner of the regenerative-heating-type alternate combustion system 4, e.g., the burner 5, into combustion and exhausting the combustion gas through the combustion gas exhaust system 9 of the other burner in rest, e.g., the burner 6 of the other regenerative-heating-type alternate combustion system, the flame and the combustion gas flow parallel to the heating tube 3 and the combustion gas is then exhausted externally of the furnace without flowing out to any other zone 2. At this time, the fluid to be heated flowing into the heating tubes 3 is heated by radiation-heat of the flame and the combustion gas. Because the combustion air is supplied into the burner body 14 after being preheated in the regenerative bed 7, that is at a high temperature (about 1000° C.), close to the exhaust gas temperature and, therefore, in case of being mixed with the fuel injected through the fuel nozzle 15, the combustion is stable even with a less amount of fuel and the high-temperature combustion gas can be obtained. Also, since the temperature of the combustion air is quickly changed in response to an increase or decrease in the amount of combustion, it is easy to make a desired adjustment in temperature of the combustion gas, with a high response. As for the other burner 6, the fuel supply system 11 connected to the burner 6 is closed by the three-way valve 12 and the four-way valve 10 is changed over to connect the burner 6 with the combustion gas exhaust system 9, so that the burner 6 is not brought into combustion and utilized as an exhaust passage for the exhaust combustion gas. Specifically, the exhaust combustion gas passes through the burner 6 in rest and the associated regenerative bed 7, while releasing heat to the regenerative bed 7, and the resulting low-temperature gas is exhausted through the four-way valve 10. Therefore, the combustion gas generated in each of zones 2*a*, 2*b*, 2*c* and 2*d* are exhausted through the regenerative bed 7 externally of the furnace without flowing out to any other zone. Consequently, the temperature control for each of the zones 2*a*, 2*b*, 2*c* and 2*d* can be achieved independently each other by the regenerative-heating-type alternate combustion systems. Therefore, by controlling the amount of combustion of each of the zones 2*a*, 2*b*, 2*c* and 2*d* independently, each heat flux pattern in the respective zones 2*a*, 2*b*, 2*c* and 2*d* can be set to such a pattern that the boundary layer temperature of the fluid to be heated for all the zones are held lower than the coking temperature or the allowable maximum temperature which is determined in consideration of material used as the heating tube and are almost the same temperature level. Namely, a highest possible heat flux can be set in each of the zones 2*a*, 2*b*, 2*c* and 2*d*, close to a critical degree within which to prevent coking. The operation of the furnace in this situation is, for example, performed in such a manner as to determine a combustion amount beforehand for the regenerative-heating-type alternate combustion systems 4, 4, . . . , 4 of each of the zones 2*a*, 2*b*, 2*c* and 2*d* in match with the above heat flux pattern, and to control the amount of combustion in the entire furnace by using a temperature sensor 24 disposed at the outlet of the furnace so that the temperature of the fluid to be heated at the outlet of furnace is held at a set temperature without changing the ratios of each combustion amount to the entire combustion amount. Therefore, the treating quantity can be controlled, maintaining the high heating efficiency. For that operation purpose, a temperature sensor 24, which is disposed at the outlet of the furnace, will work to determine the temperature of fluid at the furnace outlet, and depending upon such determined temperature the furnace should be operated to change the combustion amount in the regenerative-heating-type alternate combustion systems 4 in each zone, at a same proportion. Switchover between combustion and exhaustion is carried out with, for example, intervals in a range of 20 seconds to 2 minutes, preferably within about 1 minute, most preferably with about 40 seconds, or each time the exhausted combustion gas reaches a predetermined temperature, e.g., about 200° C.

Figure 4A:
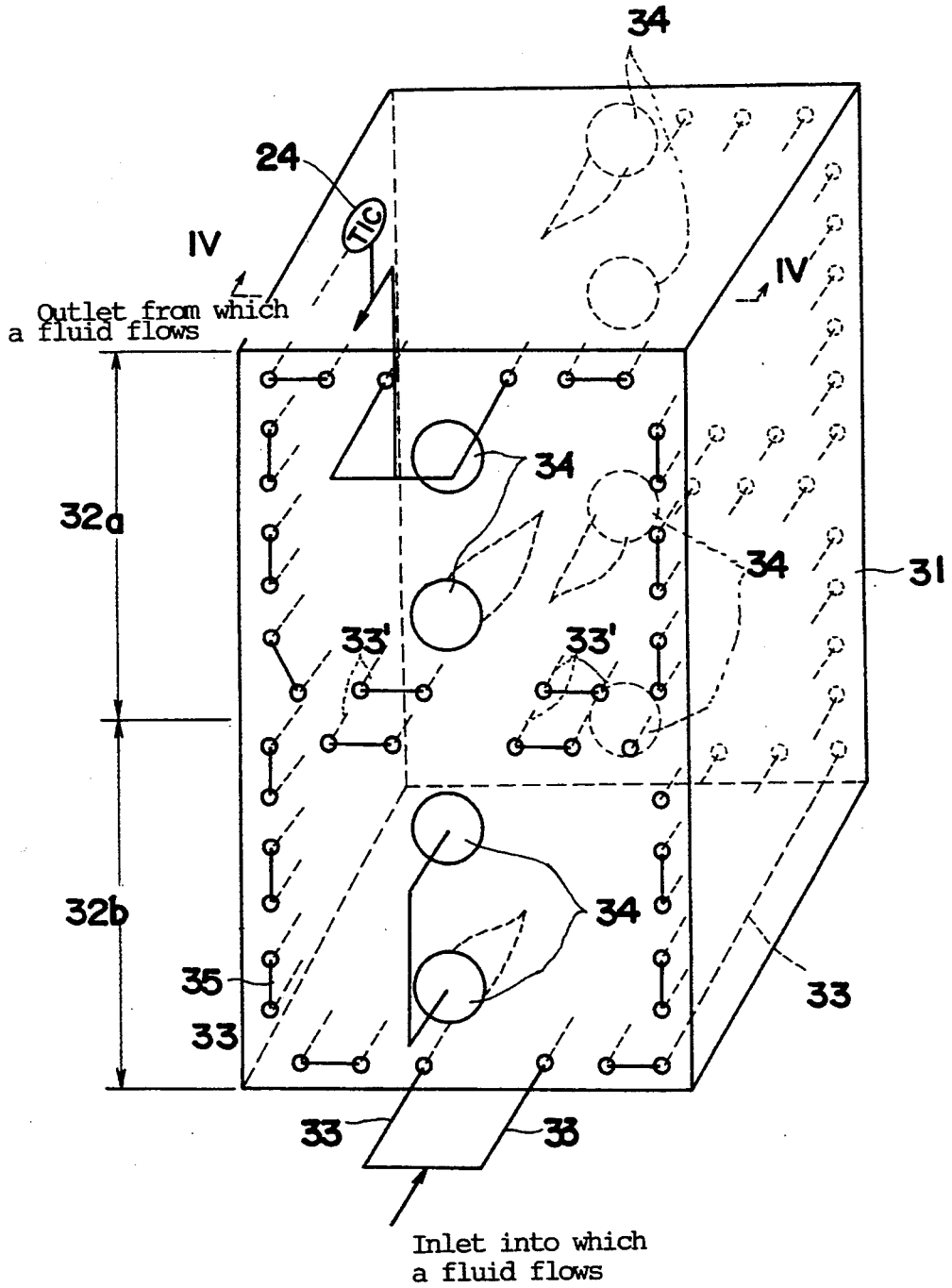
FIG. 4A is a schematic view showing another embodiment of the tubular furnace of the present invention.
Figure 4B:
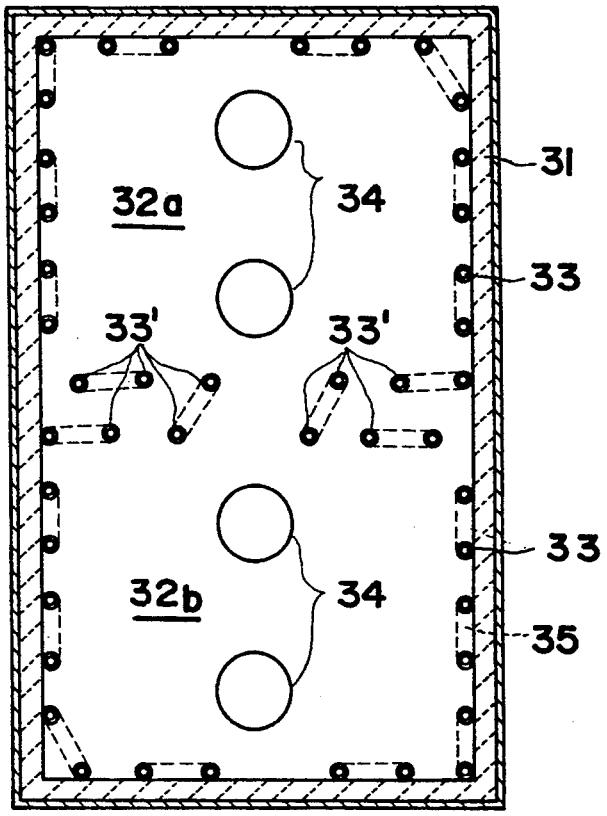
FIG. 4B is a sectional view along the line IV—IV of FIG. 4A.

FIGS. 4A and 4B shows an another embodiment. In this embodiment, a plurality of zones may be defined by modifying arrangement of the heating tube 33 which forms the coil path.

other words, the furnace body 31 may be of the simple rectangular configuration and a part of heating tubes 33 disposed along the wall surface of the furnace may be protruded toward the center of the furnace to thereby define a plurality of zones 32*a*, 32*b*. The heating tube 33 introduced from the bottom of the furnace 31 is divided into two path coils and each coil path is disposed along the both side wall surface of the furnace. Each heating tubes 33, 33, . . . , 33 are connected by U-shaped joint tube 35 and become coil path respectively. And, a part of heating tubes 33, 33, . . . , 33 installed along the furnace wall e.g., those heating tubes 33', 33' which are located in an intermediate area of the furnace, are disposed away from the furnace wall toward the furnace center to partition the furnace. By so arranging, the heating tubes 33, 33, . . . , 33 in the lower than the heating tubes 33', 33' present a first zone and the heating tubes 33, 33, . . . , 33 in the upper than the heating tubes 33', 33' present a second zone, whereby each of the coil paths is divided into two zones. Regenerative-heating-type alternate combustion systems 34, 34, . . . , 34 are disposed one for each furnace wall in the respective zones 32*a*, 32*b* such that a flame is formed parallel to the heating tubes 33, 33, . . . , 33 and combustion gas is exhausted through a burner of the other regenerative-heating-type alternate combustion system 34 on the opposite wall surface. In this case also, the control is made such that the combustion gas generated in each of the zones 32*a*, 32*b* is exhausted out of the system by utilizing the burner in the same zone but not in combustion, and hence the combustion gas will not flow out to the other zone, particularly the downstream zone, to prevent that zone from being affected. In the case of this embodiment, the amount of combustion is controlled in the entire furnace by using a temperature sensor 21 located at the outlet of the furnace like the above embodiment of FIG. 2.

Figure 5A:
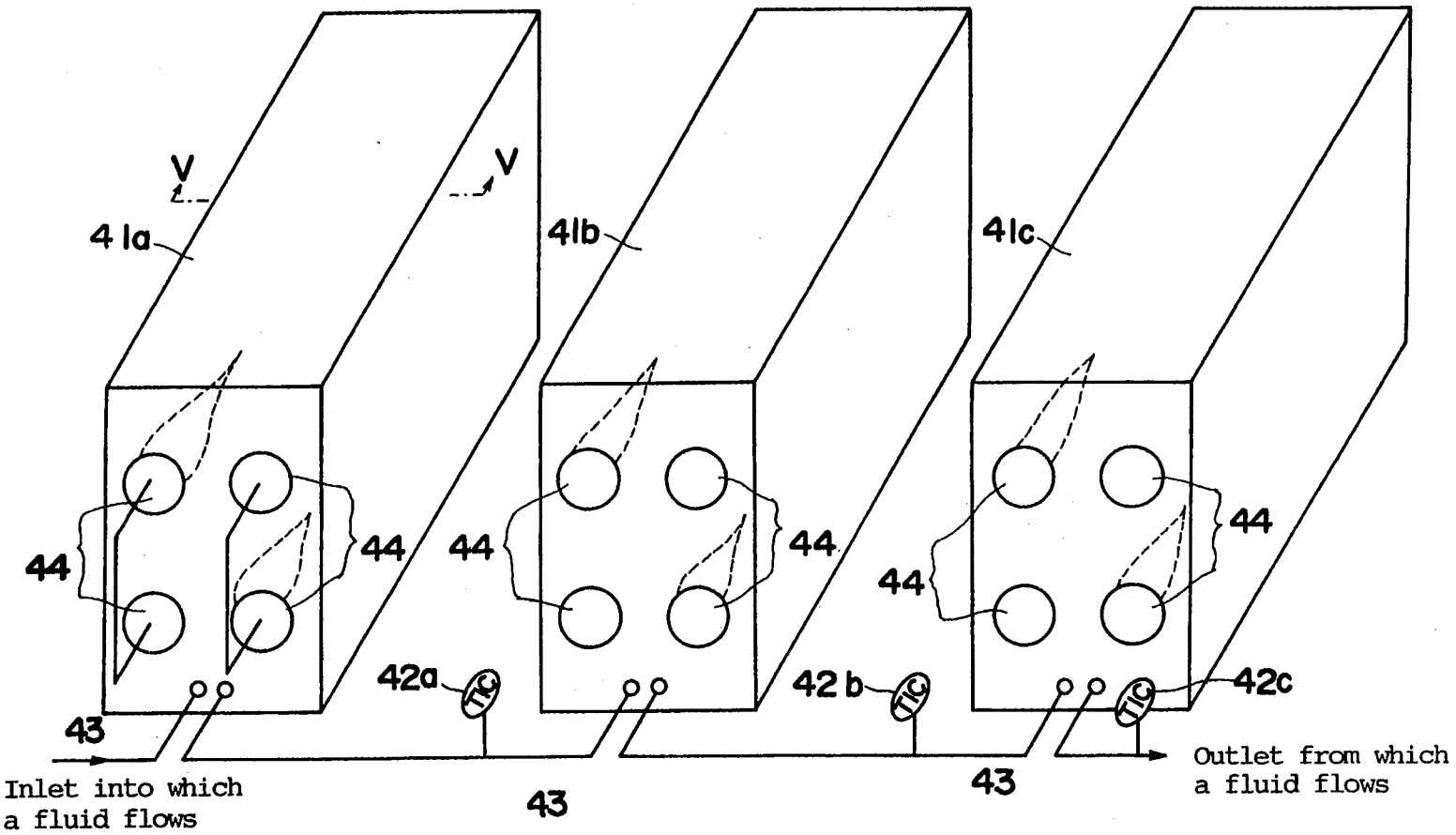
FIG. 5A is a schematic view showing still another embodiment of the tubular furnace of the present invention.
Figure 5B:
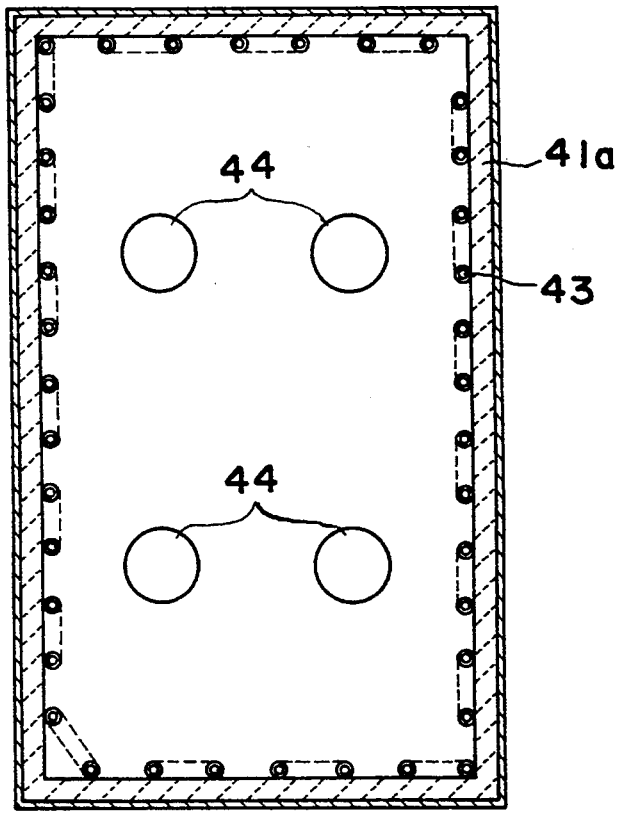
FIG. 5B is a sectional view along the line V—V of FIG. 5A.

FIGS. 5A and 5B shows a still another embodiment. In this embodiment, a plurality of furnaces 41*a*, 41*b* and 41*c* are provided and connected to each other so that a single coil path is divided into a plurality of zones. This embodiment is different from the other embodiments in that the zones are respectively constituted by the furnaces 41*a*, 41*b* and 41*c* independent of each other and temperature sensors 42*a*, 42*b* and 42*c* are installed at respective outlets of zones 41*a*, 41*b* and 41*c* to control the amount of combustion for each zone. Stated otherwise, the amount of combustion is controlled so that the fluid to be heated has a temperature set for each of the zones and the best heat flux pattern for each of the zones can be achieved. Additionally, designations 44 denote regenerative-heating-type alternate combustion systems. Each one of above embodiments is preferable embodiment, however, the present invention is not particularly limited to those constructions and may adopt any other suitable embodiments without departing from the gist and scopes thereof. For example, although the illustrated embodiments use the four-way valve as flow passage changeover means for selectively connecting the combustion air supply system 8 and the exhaust system 9 to the regenerative bed 7, the present invention is not particularly limited to that construction and may adopt any other suitable flow passage changeover means such as a flow passage changeover valve of spool type.

What is claimed is:

1. A tubular furnace having: a furnace body; coil paths composed of heating tubes provided in the furnace body to pass through a fluid to be heated; means of dividing the path into a plurality of zones; and at least one or more regenerative-heating-type alternate combustion systems provided for each of said zones; wherein the temperature in said furnace is independently controlled for each of said zones.

2. A tubular furnace according to claim 1, wherein the division of the coil path in relation to said zones is formed by pass partition plates that are a part of the furnace body being protruded to the coil path and the regenerative-heating-type alternate combustion systems are provided on the pass partition plates, each combustion system having a flame which is formed parallel to the coil path.

3. A tubular furnace according to claim 1, wherein the furnace body has a wall surface and an interior, the division of the coil path in relation to said zones is formed by some of said heating tubes which protrude into the interior of the furnace body from the wall surface of the furnace body.

4. A tubular furnace according to claim 1, wherein the division of the coil path in relation to said zones is formed by the furnace body being a plurality of independent furnaces.

5. A tubular furnace according to claim 1, wherein said regenerative-heating-type alternate combustion systems comprise two burners, each having a regenerative bed, as a pair, and said burners are alternately brought into combustion for a short period of time.

6. A tubular furnace according to claim 1, wherein heat flux patterns by said regenerative-heating-type alternate combustion systems in the respective zones are set to such a pattern that the boundary layer temperature of the fluid to be heated for all the zones are held lower than a coking temperature or an allowable maximum temperature which is determined in consideration of material used as a heating tube, and the above boundary layer temperature are almost the same temperature level.

7. A method of controlling a combustion of a tubular furnace according to claim 6, wherein said regenerative-heating-type alternate combustion system has a combustion amount which is determined beforehand for each of said zones in match with said heat flux patterns for each of said zones, and an entire amount of combustion in the entire furnace is controlled so that the temperature of the fluid to be heated at the outlet of said furnace is held at a set temperature without changing the ratios of each said combustion amount to the entire combustion amount.

8. A method of controlling a combustion of a tubular furnace according to claim 6, wherein the outlet temperature of the fluid to be heated for each of said zones is detected and the amount of combustion is controlled for each zone so that the temperature of the fluid to be heated is held at the set temperature.

* * * * *